United States Patent [19]

Donomoto et al.

[11] Patent Number: 4,457,979

[45] Date of Patent: Jul. 3, 1984

[54] COMPOSITE MATERIAL INCLUDING ALPHA ALUMINA FIBERS

[75] Inventors: Tadashi Donomoto; Mototsugu Koyama; both of Toyota; Jaji Miyake; Okazaki, and Yoshio Furva; Toyota, all of Japan

[73] Assignee: Toyota Jidosha Kabushiki Kaisha, Toyota, Japan

[21] Appl. No.: 392,143

[22] Filed: Jun. 25, 1982

[30] Foreign Application Priority Data

Nov. 30, 1981 [JP] Japan ..... 56-191923

[51] Int. Cl.[3] ..... B21D 39/00; B32B 7/00

[52] U.S. Cl. ..... 428/614; 428/608

[58] Field of Search ..... 428/614, 608

[56] References Cited

U.S. PATENT DOCUMENTS 3,970,136 7/1976 Cannell et al. ..... 428/614

4,141,802 2/1979 Duparque et al. ..... 428/614

FOREIGN PATENT DOCUMENTS 56-23242 3/1981 Japan ..... 428/614

*Primary Examiner*—Veronica O'Keefe

*Attorney, Agent, or Firm*—Oblon, Fisher, Spivak, McClelland & Maier

[57] ABSTRACT

A fiber reinforced metal type composite material. The reinforcing fiber is alumina fiber formed from at least 80% by weight alumina and the remainder silica, with the alpha alumina content of the alumina approximately between about 5% and about 60% by weight of the total amount of alumina. The matrix metal is selected from the group consisting of aluminum, magnesium, and their alloys. Thereby mechanical strength, resistance to wear, and workability of the fiber reinforced metal type composite material are good, and also friction wear on elements which frictionally rub against and mate with components made of the fiber reinforced metal type composite material is low.

2 Claims, 11 Drawing Figures

COMPOSITE MATERIAL INCLUDING ALPHA ALUMINA FIBERS

BACKGROUND OF THE INVENTION

The present invention relates to a fiber reinforced metal type composite material, and more particularly refers to a fiber reinforced metal type composite material in which the reinforcing fiber material is alumina fiber and the matrix metal is a light metal such as aluminum, magnesium, or an alloy of one of these.

Various elements and members of various machines are required to have particular mechanical properties in various of their portions. For example, when two mechanical parts or portions slide on one another in rubbing frictional contact, it is required that good strength and rigidity of the mutually contacting portions should be available, together with superior anti wear characteristics of the mutually contacting portions. As one method of improving the strength and rigidity characteristics of such mutually contacting and rubbing portions, and of improving the anti wear characteristics thereof, it has been conceived of, and put into practice, to construct these mutually rubbing and contacting portions of composite material using reinforcing fibers within a matrix of matrix metal, which is usually a light metal such as aluminum or magnesium.

One known such fiber reinforced metal type composite material uses alumina/silica fibers as the reinforcing fiber material and aluminum, magnesium, or alloys thereof as the matrix metal, and using this fiber reinforced metal type composite material it is possible to substantially improve the strength and anti wear characteristics of elements made therefrom which are subject to rubbing frictional contact. However, a problem that has arisen with such composite materials using alumina/silica fibers as the reinforcing material is that, because the alumina/silica fibers are very much harder than the aluminum or magnesium matrix metal, the members which bear against and rub against the parts made from such a composite material made of alumina/silica fibers and aluminum, magnesium, or an alloy thereof as matrix metal tend to be worn away quickly. Further, machining of the composite material is also very difficult. These problems are particularly prominent in the case of a composite material using alumina/silica reinforcing fibers which are more than about 80% by weight composed of alumina, with the remainder silica, although from the point of view of having high compatibility with aluminum alloys and the like and superior heat resistance characteristics these high alumina type alumina/silica reinforcing fibers are preferable.

Now, various different crystalline structures exist for alumina. In particular, of these so called alpha alumina is the most stable one, and is known already to have high hardness and elasticity. For example, so called alumina short fibers, which are currently sold as a heat resistant material, commonly have an alpha alumina proportion by weight of 60% or more, i.e. the ratio of the amount of alpha alumina present therein to the total amount of alumina present therein is 60% or more. Thus, it would be expected and has been formerly considered that: the higher is the proportion of alpha alumina present in the alumina of the alumina/silica reinforcing fibers of a composite material including alumina/silica fibers as reinforcing material and aluminum, magnesium, or an alloy thereof as the matrix metal, the higher are the mechanical strength, the rigidity, and the resistance to wear of rubbing elements made from said composite material; but also the higher is the amount of wear on a mating element which rubbingly mates against said rubbing element made from said composite material, which is highly undesirable; and also workability of the composite material is decreased.

SUMMARY OF THE INVENTION

However, the present inventors have made extensive researches, as will hereinafter be partially detailed and explained, in an effort to elucidate the nature of the dependence of the wearing characteristics of an element made from composite material and of a mating element which rubs thereagainst, on the proportion of alpha alumina in the alumina of the alumina/silica reinforcing fibers of the composite material, and of the workability of said composite material on said alpha alumina proportion; and have discovered the following very surprising fact: if the proportion of alpha alumina is within a specified range which will be explained hereinafter, then the amount of wear on the mating element is very acceptably low, as well as is the amount of wear on the composite material element itself; and also the workability of the composite material is good; while excellent values for fatigue strength of the composite material are obtained within this particular range, as well.

Based upon this realization, it is the primary object of the present invention to provide a composite material reinforced with alumina/silica fibers and using aluminum or magnesium or an alloy thereof as the matrix metal, which provides good wear resistance for a mating element which frictionally rubs against a member made from said composite material.

It is a further object of the present invention to provide such a composite material reinforced with alumina/silica fibers and using aluminum or magnesium or an alloy thereof as the matrix metal, which also provides good wear resistance for said member made from composite material which is rubbing against said mating element.

It is a further object of the present invention to provide such a composite material reinforced with alumina/silica fibers and using aluminum or magnesium or an alloy thereof as the matrix metal, which also provides good workability for said member made from composite material which is rubbing against said mating element.

It is a further object of the present invention to provide such a composite material reinforced with alumina/silica fibers and using aluminum or magnesium or an alloy thereof as the matrix metal, which also provides good rigidity for said member made from composite material which is rubbing against said mating element.

It is a further object of the present invention to provide such a composite material reinforced with alumina/silica fibers and using aluminum or magnesium or an alloy thereof as the matrix metal, which also provides good strength for said member made from composite material which is rubbing against said mating element.

According to the present invention, these and other objects are accomplished by a fiber reinforced metal type composite material: in which the fiber reinforcing material is alumina fiber material formed from at least 80% by weight alumina and the remainder substantially silica, with the alpha alumina content of the alumina approximately between about 5% and about 60% by weight of the total amount of alumina; and in which the matrix metal is selected from the group consisting of aluminum, magnesium, and their alloys.

According to such a composition, by the proportion of alpha alumina in the reinforcing fibers being restricted to the aforesaid range of 5% to 60% by weight of the total amount of alumina in the reinforcing fibers, as has been shown by the present inventors by the experimental researches which have been mentioned above and will be detailed shortly the amount of wear on a mating element which rubs frictionally against a member made of said composite material is quite acceptably low, while preserving good workability for the composite material, and providing good wear resistance of said member made of said composite material, as well as ensuring good strength and rigidity of said member.

Further, according to a particular aspect of the present invention, these and other objects are more particularly and concretely accomplished by a fiber reinforced metal type composite material, wherein the alpha alumina content of the alumina is approximately between about 10% and about 50% by weight of the total amount of alumina.

According to such a composition, by the further restriction of the proportion of alpha alumina in the reinforcing fibers to the aforesaid range of 10% to 50% by weight of the total amount of alumina in the reinforcing fibers, as has been shown by the present inventors by the experimental researches which have been mentioned above and will be detailed shortly the amount of wear on a mating element which rubs frictionally against a member made of said composite material is still further reduced, while preserving good workability for the composite material, and providing good wear resistance of said member made of said composite material, as well as ensuring good strength and rigidity of said member.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely of the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to several preferred embodiments thereof, and with reference to the appended drawings.

THE FIRST PREFERRED EMBODIMENT, USING ALUMINUM MATRIX METAL

In order to investigate, in a fiber reinforced composite material with alumina fibers as the reinforcing material and with aluminum as the matrix metal, the effect of the proportion of alpha alumina in the alumina of the reinforcing fibers on the mechanical characteristics of the composite material, eight sets of test pieces were made of composite material using alumina fibers as the reinforcing material and aluminum matrix metal, with different proportions of alpha alumina in the reinforcing alumina fibers of each of the eight sets.

COMPOSITION OF THE TEST PIECES

The composition of each of these eight sets of test pieces can be seen as summarized in Table 1 at the end of the specification. The test pieces are designated "$A_2$", "$A_8$", "$A_{20}$", "$A_{34}$", "$A_{43}$", "$A_{61}$", "$A_{81}$", and "$A_{93}$". The alumina fiber used as reinforcing material in each of these sets of test pieces has an alpha alumina content, as a percentage of the total amount of alumina therein, substantially the same as the suffix thereof; in other words, the test piece set designated "$A_2$" has substantially 2% alpha alumina as a percentage weight of the total amount of alumina therein the test piece set designated "$A_8$" contains substantially 8% alpha alumina type alumina, the test piece set designated "$A_{20}$" contains substantially 20% alpha alumina type alumina, the test piece set designated "$A_{34}$" contains substantially 34% alpha alumina type alumina, the test piece set designated "$A_{43}$" contains substantially 43% alpha alumina type alumina, the test piece set designated "$A_{61}$" contains substantially 61% alpha alumina type alumina, the test piece set designated "$A_{81}$" contains substantially 81% alpha alumina type alumina, and the test piece set designated "$A_{93}$" contains substantially 93% alpha alumina type alumina. Each of the test piece sets, in fact, contained approximately 94.8% by weight of alumina fiber, and approximately 5.1% by weight of silica. The alumina fiber material pieces of these various types used to make the test piece sets were purchased from I. C. I., having been sold under the trademark "SAFIRU". Further, a ninth test piece set designated "B" was also made of composite material using silica/alumina fibers as the reinforcing material and aluminum matrix metal, this silica/alumina fiber material containing no alpha alumina, and being composed of 47.3% by weight alumina and about 52.6% by weight silica; this silica/alumina fiber material was purchased from Isoraito Babukokku Taika Kabushiki Kaisha, having been sold under the trademark "Kaooru".

METHOD OF MAKING THE TEST PIECES

Figure 1:
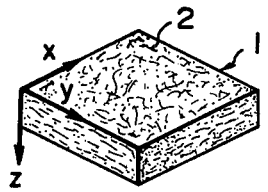
FIG. 1 is a perspective view, showing an alumina fiber mass approximately 80 mm by 20 mm, made by the vacuum forming method.

These nine sets of test pieces were each made by the following process. First the reinforcing alumina fiber, for each test piece set, was dispersed within colloidal silica. Next, the resulting mixture was well stirred, and then from the colloidal silica with the reinforcing alumina fibers dispersed within it there was formed an alumina fiber mass (designated by the reference numeral 1) approximately 80 mm by 80 mm by 20 mm, as shown in FIG. 1 of the accompanying drawings, by the vacuum forming method. Next this alumina fiber mass 1, with some silica still remaining therein, was fired at 600° C., thus bonding the reinforcing alumina fibers in the silica. In each case, as shown in FIG. 1, the orientations of the reinforcing alumina fibers (such as the alumina fiber designated by the reference numeral 2) within the x-y plane were random and were mixed, but the reinforcing alumina fibers were generally oriented in an overlapping state with respect to the z axis.

Figure 3:
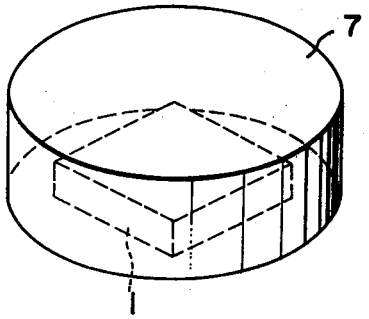
FIG. 3. is a schematic perspective view, showing the resultant solid mass, which is a solid circular cylinder, from which a plurality of test samples are to be cut.
Figure 2:
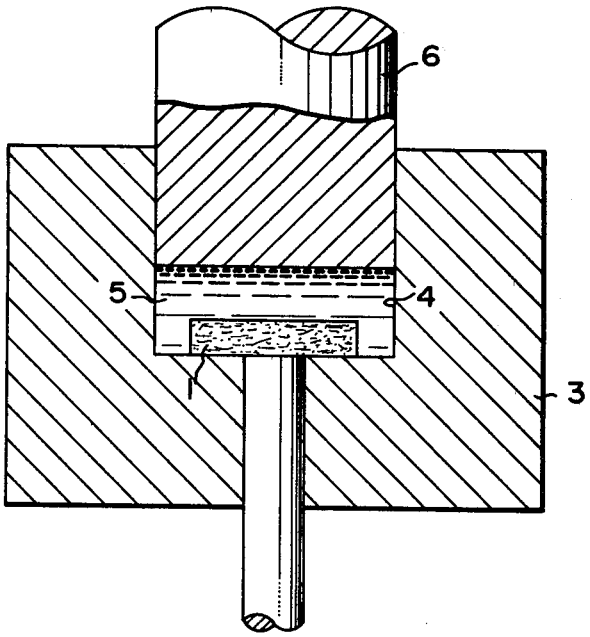
FIG. 2 is a schematic sectional illustration, showing said mass of alumina fibers as placed within a mold cavity of a mold, with a quantity of molten aluminum being poured into this mold cavity and being pressurized by a plunger adapted to slide in and closely to cooperate with the mold.

Next, as shown in FIG. 2, the mass 1 of the reinforcing alumina fibers was placed within a mold cavity 4 of a mold 3, and a quantity 5 of a molten aluminum alloy (JIS AC8A) was poured into this mold cavity 4 and was pressurized to a pressure of about 1000 kg/cm$^2$ by the use of a plunger 6, adapted to slide in and closely to cooperate with the mold 3. The pressure was maintained until all of the molten aluminum alloy 5 had completely solidified, and then the resultant solid mass 7 was removed from the mold 3. As shown in FIG. 3, this resultant solid mass 7 was a solid circular cylinder with an outer diameter of 110 mm and a height of 50 mm. Next, this solid mass 7 consisting of the aluminum alloy with a local reinforcement of the alumina fibers was subjected to heat treatment of the kind conventionally denoted by "T7" and from the part of the finished heat treated solid cylindrical mass 7 which includes the alumina fiber mass, wear test samples, cutting test samples, rotary bending test samples, tensile elasticity test samples, and hardness test samples were all cut by machining.

THE WEAR TEST RESULTS (ALUMINUM MATRIX METAL)

The nine test piece samples, eight of which were selected one from each of the test piece sets designated as "$A_2$", "$A_8$", "$A_{20}$", "$A_{34}$", "$A_{43}$", "$A_{61}$", "$A_{81}$", and "$A_{93}$", and one of which was selected from the test piece set designated as "B", along with a comparison test piece sample designated as "$A_a$" which was formed of the same aluminum alloy (JIS AC8A) with no reinforcing fibers and which had been treated with the aforesaid heat treatment of the kind conventionally denoted by "T7", were in turn mounted in a friction wear test device, and were in turn rubbed against a fresh outer surface of a cylindrical mating element at a rubbing speed of 0.3 meters/sec for one hour. The cylindrical mating element was in each case made of spheroidal graphite cast iron (JIS FCD70), and the rubbing surfaces were pressed together with a pressure of 20 kg/mm$^2$ and were kept constantly lubricated with Castle motor oil 5W-30 kept at room temperature.

Figure 4:
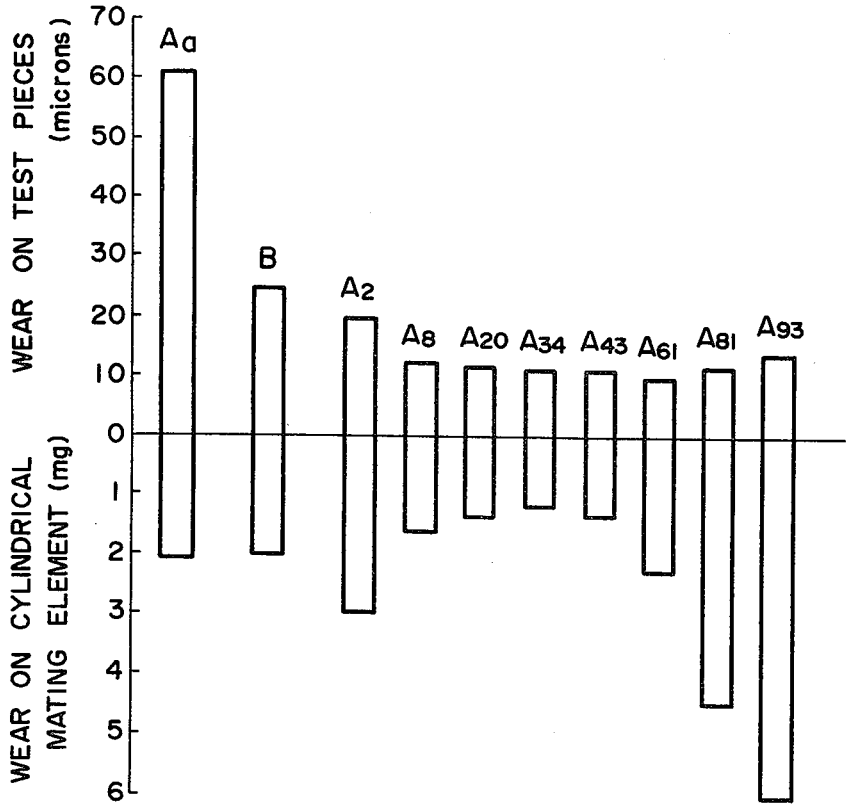
FIG. 4 is a dual histogram, of which the upper part relates to the test piece samples, and the lower part relates to a cylindrical mating element which is made of cast iron, in which wear on the test piece sample in microns is shown upwards and wear on the cylindrical mating element in mg is shown downwards, showing for each of a total of ten test piece samples designated as "$A_a$", "B", "$A_2$", "$A_8$", "$A_{20}$", "$A_{34}$", "$A_{43}$", "$A_{61}$", "$A_{81}$", and "$A_{93}$" the gross amount of wear on the test piece sample and on the cylindrical mating element.
Figure 5:
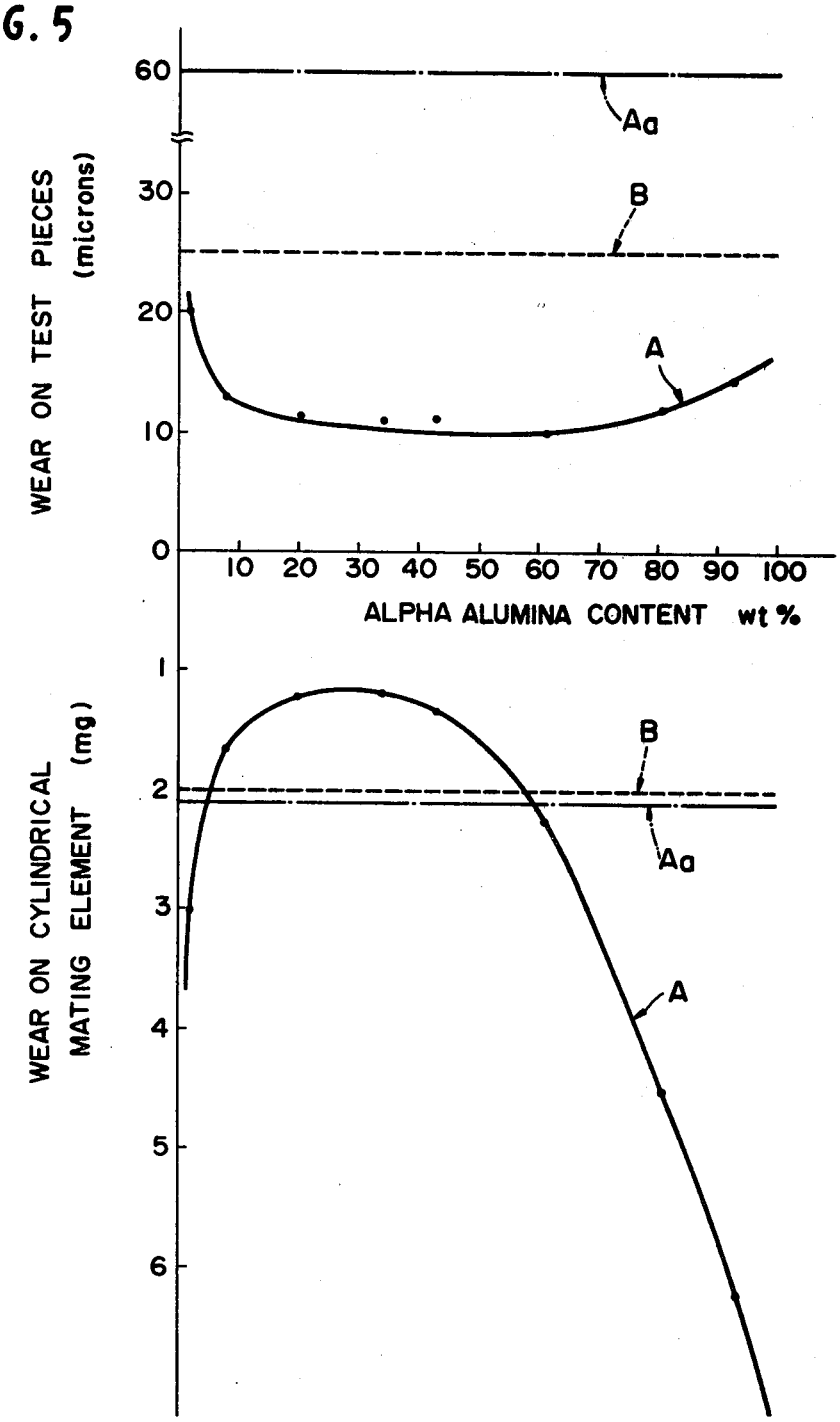
FIG. 5 is a dual graph, of which the upper part relates to the test piece samples, and the lower part relates to said cylindrical mating element which is made of cast iron, in which alpha alumina content of the test piece samples is shown on the abscissa, and wear on the test piece sample in microns is shown upwards on the ordinate while wear on the cylindrical mating element in mg is shown downwards on the ordinate, showing the variation of the amounts of wear on the test piece sample and on the cylindrical mating element with variation of the alpha alumina content of the test piece sample, and also showing the amounts of wear on the test piece sample and on the cylindrical mating element in the cases of the test piece samples designated as "$A_a$" and "B" by straight horizontal lines for purposes of convenience in comparison.

The results of these wear tests are shown in FIGS. 4 and 5. The upper parts of these figures relate to the test piece sample, and the lower parts of these figures relate to the relevant cylindrical mating element. FIG. 4 is a dual histogram, showing for each of the total of ten test piece samples designated as "$A_a$", "B", "$A_2$", "$A_8$", "$A_{20}$", "$A_{34}$", "$A_{43}$", "$A_{61}$", "$A_{81}$", and "$A_{93}$" the gross amount of wear on the test piece sample and on the cylindrical mating element; and FIG. 5 is a dual graph, in which alpha alumina content of the test piece sample is shown on the abscissa and wear amounts are shown on the ordinates, showing the variation of the amounts of wear on the test piece sample and on the cylindrical mating element with variation of the alpha alumina content of the test piece sample, and showing the amounts of wear on the test piece sample and on the cylindrical mating element in the cases of the test piece samples designated as "$A_a$" and "B" by straight horizontal lines for purposes of convenience in comparison.

From these figures, and particularly from FIG. 5, referring to their upper parts, it will be seen that generally the wear amounts of the test piece samples that were the ones composite reinforced with the alumina fibers, i.e. the wear amounts of the test piece samples designated as "$A_2$", "$A_8$", "$A_{20}$", "$A_{34}$", "$A_{43}$", "$A_{61}$", "$A_{81}$", and "$A_{93}$", were considerably less than the wear amount of the test piece sample designated as "B" which was reinforced with the silica/alumina fibers, or the wear amount of the same aluminum alloy test piece sample designated as "$A_a$" which was not reinforced; and particularly the wear amounts of the test piece samples that were the ones composite reinforced with the alumina fibers with an alpha alumina content of between 5% and 95% by weight, in which the test piece samples designated as "$A_8$", "$A_{20}$", "$A_{34}$", "$A_{43}$", "$A_{61}$", "$A_{81}$", and "$A_{93}$" were included, were very considerably low; and even more particularly the wear amounts of the test piece samples that were the ones composite reinforced with the alumina fibers with an alpha alumina content of between 10% and 85% by weight, in which the test piece samples designated as "$A_{20}$", "$A_{34}$", "$A_{43}$", "$A_{61}$", and "$A_{81}$" were included, were even more considerably low. Now, referring to the lower parts of FIGS. 4 and 5, with relation to the wear amount of the cylindrical mating element, this wear amount is rather high when the alpha alumina content of the test piece sample is outside the range of 5% to 60% by weight, i.e. is higher than the corresponding wear amount in the case of the test piece sample "$A_a$" formed of the unreinforced aluminum alloy or in the case of the test piece sample "B" reinforced with the silica/alumina fibers; but, on the other hand, when the alpha alumina content of the reinforcing alumina fibers of the test piece sample is between 5% and 60% by weight or thereabouts, in which the test piece samples designated as "$A_8$", "$A_{20}$", "$A_{34}$", "$A_{43}$", and "$A_{61}$" were included, the wear amount of the cylindrical mating element is less than or comparable to the corresponding wear amount in the case of the test piece sample "$A_a$" formed of the unreinforced aluminum alloy or in the case of the test piece sample "B" reinforced with the silica/alumina fibers; and furthermore, particularly in the case when the alpha alumina content of the reinforcing alumina fibers of the test piece sample is between 10% and 50% by weight or thereabouts, in which the test piece samples designated as "$A_{20}$", "$A_{34}$", and "$A_{43}$" were included, the wear amount of the cylindrical mating element is very substantially less than the corresponding wear amount in the case of the test piece sample "$A_a$" formed of the unreinforced aluminum alloy or in the case of the test piece sample "B" reinforced with the silica/alumina fibers, and in fact is very small in an absolute sense.

Figure 6:
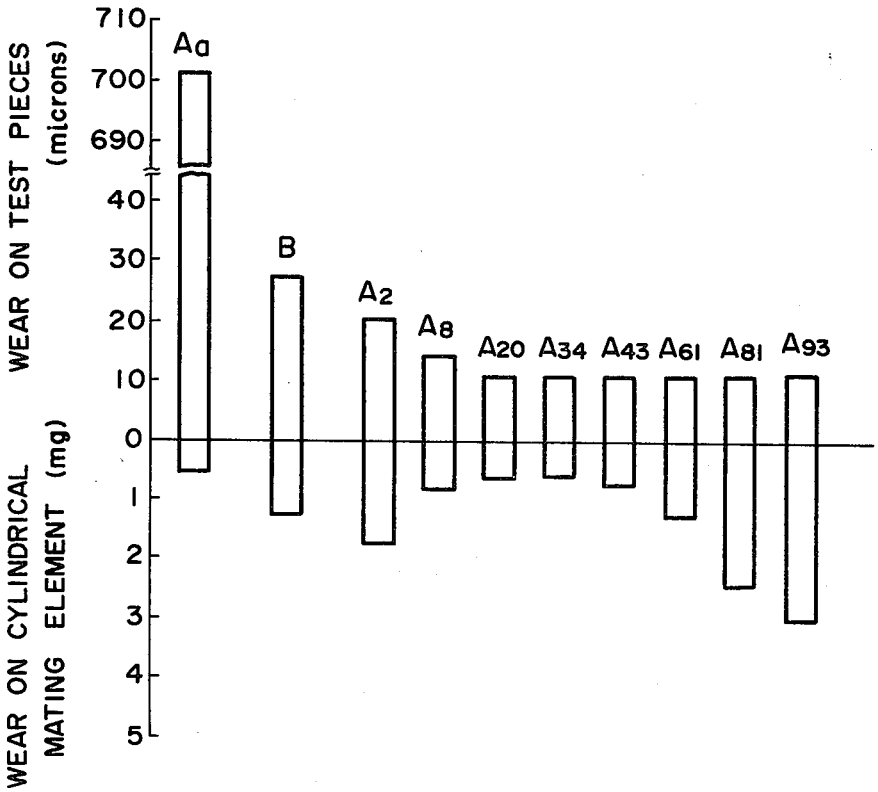
FIG. 6 is a dual histogram, similar to FIG. 4, of which the upper part relates to the test piece samples, and the lower part relates to a cylindrical mating element which this time is made of chrome steel, in which wear on the test piece sample in microns is shown upwards and wear on the cylindrical mating element in mg is shown downwards, showing for each of a total of ten test piece samples again designated as "$A_a$", "B", "$A_2$", "$A_8$", "$A_{20}$", "$A_{34}$", "$A_{43}$", "$A_{61}$", "$A_{81}$", and "$A_{93}$" the gross amount of wear on the test piece sample and on the cylindrical mating element.
Figure 7:
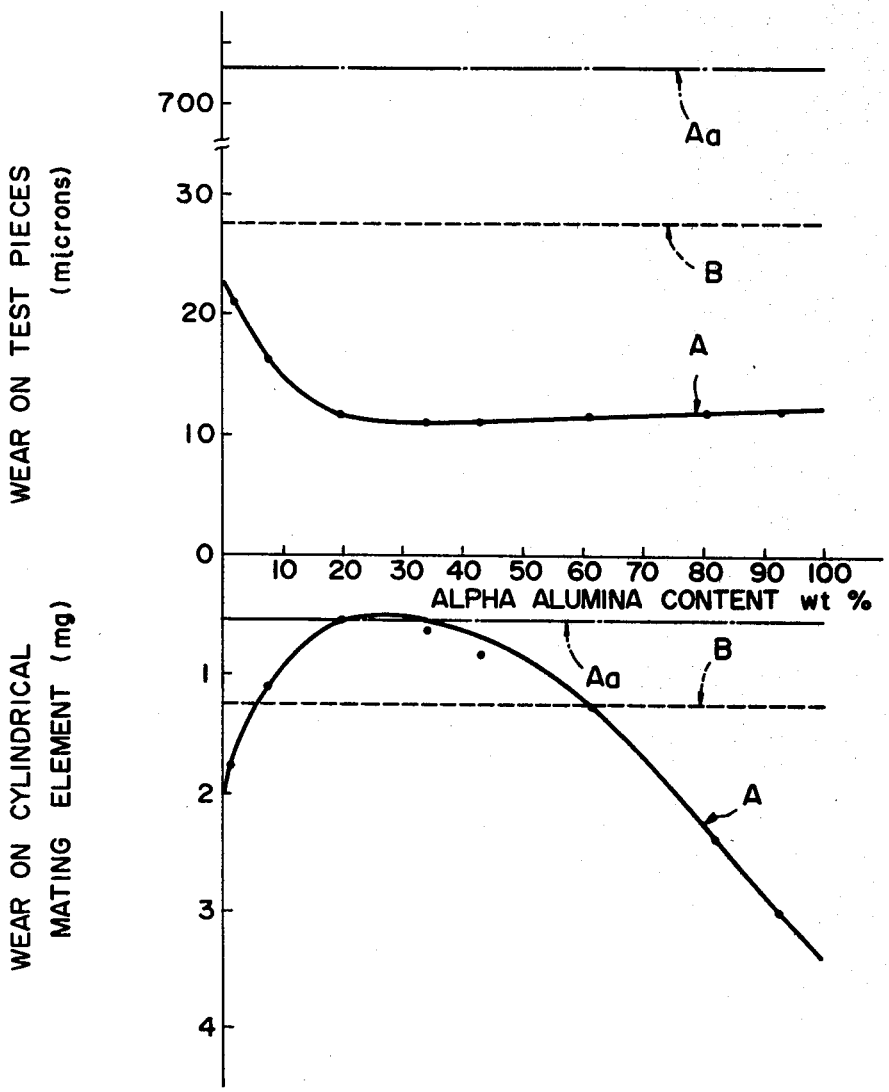
FIG. 7 is a dual graph, similar to FIG. 5, of which the upper part relates to the test piece samples, and the lower part relates to said cylindrical mating element which this time is made of chrome steel, in which alpha alumina content of the test piece samples is shown on the abscissa, and wear on the test piece sample in microns is shown upwards on the ordinate while wear on the cylindrical mating element in mg is shown downwards on the ordinate, showing the variation of the amounts of wear on the test piece sample and on the cylindrical mating element with variation of the alpha alumina content of the test piece sample, and also showing the amounts of wear on the test piece sample and on the cylindrical mating element in the cases of the test piece samples designated as "$A_a$" and "B" by straight horizontal lines for purposes of convenience in comparison.

Now, FIGS. 6 and 7 are dual graphs, similar to FIGS. 4 and 5, showing the results of similar wear tests performed using a cylindrical mating element formed this time of a chrome steel (JIS SCr20) hardened with cementation (hardness Hv=720). Again, the parts of these figures relate to the test piece sample, and the lower parts of these figures relate to the relevant cylindrical mating element. FIG. 6 is a dual histogram, showing for each of the total of ten test piece samples designated as "$A_a$", "B", "$A_2$", "$A_8$", "$A_{20}$", "$A_{34}$", "$A_{43}$", "$A_{61}$", "$A_{81}$", and "$A_{93}$" the gross amount of wear on the test piece sample and on the cylindrical mating element; and FIG. 7 is a dual graph, in which alpha alumina content of the test piece sample is shown on the abscissa and wear amounts are shown on the ordinates, showing the variation of the amounts of wear on the test piece sample and on the cylindrical mating element with variation of the alpha alumina content of the test piece sample, and showing the amounts of wear on the test piece sample and on the cylindrical mating element in the cases of the test piece samples designated as "$A_a$" and "B" by straight horizontal lines for purposes of convenience in comparison.

From these figures, and particularly from FIG. 7, referring to their upper parts, it will be seen that generally the wear amounts of the test piece samples that were the ones composite reinforced with the alumina fibers, i.e. the wear amounts of the test piece samples designated as "$A_2$", "$A_8$", "$A_{20}$", "$A_{34}$", "$A_{43}$", "$A_{61}$", "$A_{81}$", and "$A_{93}$", were considerably less than the wear amount of the test piece sample designated as "B" which was reinforced with the silica/alumina fibers, or the wear amount of the same aluminum alloy test piece sample designated as "$A_a$" which was not reinforced; and particularly the wear amounts of the test piece samples that were the ones composite reinforced with the alumina fibers with an alpha alumina content of at least 5% by weight, preferably about 10% by weight, in which the test piece samples designated as "$A_8$", "$A_{20}$", "$A_{34}$", "$A_{43}$", "$A_{61}$", "$A_{81}$", and "$A_{93}$" were included, were very considerably low; and even more desirably the wear amounts of the test piece samples that were the ones composite reinforced with the alumina fibers with an alpha alumina content of at least approximately 20% by weight, in which the test piece samples designated as "$A_{20}$", "$A_{34}$", "$A_{43}$", "$A_{61}$", "$A_{81}$", and "$A_{93}$" were included, were even more considerably low. Now, referring to the lower parts of FIGS. 6 and 7, with relation to the wear amount of the cylindrical mating element, this wear amount is rather high when the alpha alumina content of the test piece sample is outside the range of 5% to 60% by weight, i.e. is higher than the corresponding wear amount in the case of the test piece sample "B" reinforced with the silica/alumina fibers; but, on the other hand, when the alpha alumina content of the reinforcing alumina fibers of the test piece sample is between 5% and 60% by weight or thereabouts, in which the test piece samples designated as "$A_8$", "$A_{20}$", "$A_{34}$", "$A_{43}$", and "$A_{61}$" were included, the wear amount of the cylindrical mating element is less than or comparable to the corresponding wear amount in the case of the test piece sample "B" reinforced with the silica/alumina fibers; and furthermore, particularly in the case when the alpha alumina content of the reinforcing alumina fibers of the test piece sample is between 10% and 50% by weight or thereabouts, in which the test piece samples designated as "$A_{20}$", "$A_{34}$", and "$A_{43}$" were included, the wear amount of the cylindrical mating element is very substantially less than the corresponding wear amount in the case of the test piece sample "B" reinforced with the silica/alumina fibers, and is comparable to that in the case of the test piece sample "$A_a$" formed of the unreinforced aluminum alloy, and in fact is very small in an absolute sense.

From these wear test results, there has been drawn by the present inventors the conclusion that in order for the composite reinforced material according to the present invention not to wear away too violently a mating member against which it rubs, while having adequate wearing characteristics of its own, the alpha alumina content by weight of the alumina reinforcing fibers should be approximately within the range 5% to 60%; and more preferably should be approximately within the range 10% to 50%.

THE CUTTING TEST RESULTS

Figure 8:
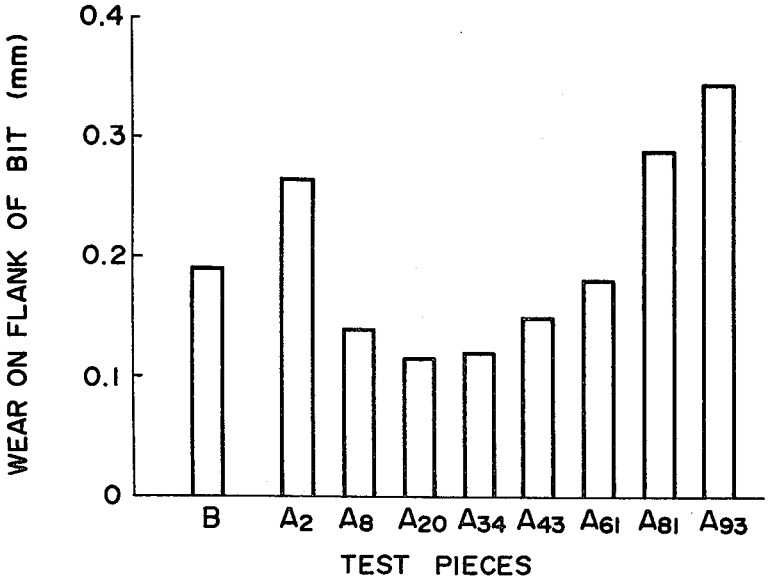
FIG. 8 is a histogram, showing the amount of wear on the flank of a superhard bit which was used to cut each of nine test piece samples, eight of which were selected one from each of the test piece sets designated as "$A_2$", "$A_8$", "$A_{20}$", "$A_{34}$", "$A_{43}$", "$A_{61}$", "$A_{81}$", and "$A_{93}$", and one of which was selected from the test piece set designated as "B"

Next, nine test piece samples, eight of which were selected one from each of the test piece sets designated as "$A_2$", "$A_8$", "$A_{20}$", "$A_{34}$", "$A_{43}$", "$A_{61}$", "$A_{81}$", and "$A_{93}$", and one of which was selected from the test piece set designated as "B", were in turn cut for a fixed cutting amount, using a superhard bit, a cutting speed of 150 m/min, and a feed amount of 0.03 mm/revolution, using water as a coolant. The amount of wear on the flank of the superhard bit was measured, and the results of these measurements are shown in FIG. 8, which is a histogram.

From this figure, it can be seen that when the alpha alumina content be weight of the reinforcing alumina fibers was in the above described preferred range for the present invention of 5% to 60%, in which the test piece samples designated as "$A_8$", "$A_{20}$", "$A_{34}$", "$A_{43}$", and "$A_{61}$" were included, the wear amount of the flank of the superhard bit was quite low, and therefore the test piece sample had good workability; and furthermore, particularly in the case when the alpha alumina content of the reinforcing alumina fibers of the test piece sample was between 10% and 50% by weight or thereabouts, and thus the alpha alumina content by weight of the reinforcing alumina fibers was in the above described more preferred range for the present invention of 10% to 50%, in which the test piece samples designated as "$A_{20}$", "$A_{34}$", and "$A_{43}$" were included, the wear amount of the flank of the superhard bit was even lower, and therefore the test piece sample had excellent workability.

THE ROTARY BENDING TEST RESULTS

Figure 9:
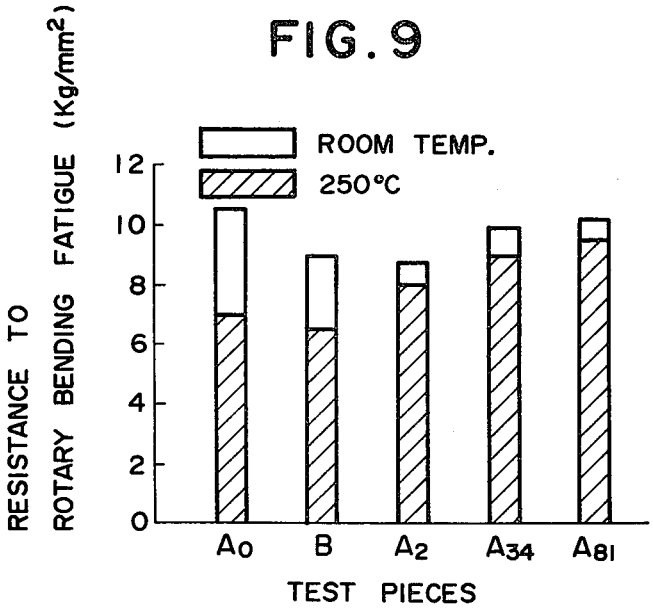
FIG. 9 is a histogram, in which the shaded bars relate to measurements at 250° C., and the plain bars relate to measurements at room temperature, showing, for each of five test piece samples, three of which were selected one from each of the test piece sets designated as "$A_2$", "$A_{34}$", and "$A_{81}$", one of which was selected from the test piece set designated as "B", and one of which was a comparison test piece sample formed of aluminum alloy with no reinforcing fibers, the results of a rotary bending fatigue test in a suitable testing machine.

Next, five test piece samples, three of which were selected one from each of the test piece sets designated as "$A_2$", "$A_{34}$", and "$A_{81}$", one of which was selected from the test piece set designated as "B", and one of which was a comparison test piece sample of the type previously described designated as "$A_a$" were in turn subjected to a rotary bending fatigue test in a testing machine. Each test sample was rotated about its own axis while it was subjected to a load in a perpendicular direction, and the relationship between load and the number of revolutions until rupture was investigated. In fact, this test was performed repeatedly with different load values, for each type of test piece sample, and at two different ambient temperatures: room temperature, and 250° C. For each type of test piece sample and each ambient temperature a S-N curve, which is the relation between the load and the number of revolutions which finally break the test piece, was constructed, and from this S-N curve the fatigue strength to withstand $10^7$ revolutions was obtained. The results of these measurements and derivations are shown in FIG. 9, which is a histogram, in which the shaded bars relate to the measurements at 250° C., and the plain bars relate to the measurements at room temperature.

From this figure, it can be seen that the higher becomes the alpha alumina content by weight of the reinforcing alumina fibers, the higher becomes the strength with relation to resistance to rotary bending fatigue of the composite material including the alumina fibers, which in all cases is higher than the resistance to rotary bending fatigue of the composite material designated as "B" formed with the silica/alumina fibers; and furthermore, particularly in the case of rotary bending fatigue at high temperature, the composite material reinforced with the alumina fibers including a high proportion by weight of alpha alumina has a higher resistance to rotary bending fatigue than does the aluminum alloy with no reinforcing alumina fibers designated as "$A_a$".

THE TENSILE ELASTICITY TEST RESULTS

Figure 10:
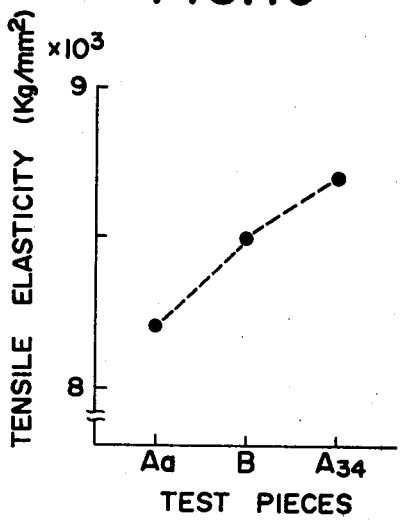
FIG. 10 is a chart, in which tensile elasticity is shown on the vertical scale, showing, for each of three test piece samples, one of which was selected from the test piece set designated as "$A_{34}$", one of which was selected from the test piece set designated as "B", and one of which was a comparison test piece sample formed of aluminum alloy with no reinforcing fibers, the particular tensile elasticity thereof.

Next, three test piece samples, one of which was selected from the test piece set designated as "$A_{34}$", one of which was selected from the test piece set designated as "B", and one of which was a comparison test piece sample of the type previously described designated as "$A_a$" were in turn subjected to measurements of tensile elasticity. The results of these measurements are shown in FIG. 10.

From this figure, it can be seen that the composite reinforcement with reinforcing fibers increases the tensile elasticity, as compared to the comparison test piece sample of the type designated as "$A_a$" with no reinforcing fibers; and particularly the composite material "$A_{34}$" reinforced with the alumina fibers with a considerable proportion of alpha alumina has a higher elasticity than does the composite material designated as "B" reinforced with the silica/alumina fibers which have no alpha alumina content.

THE HARDNESS TEST RESULTS

Figure 11:
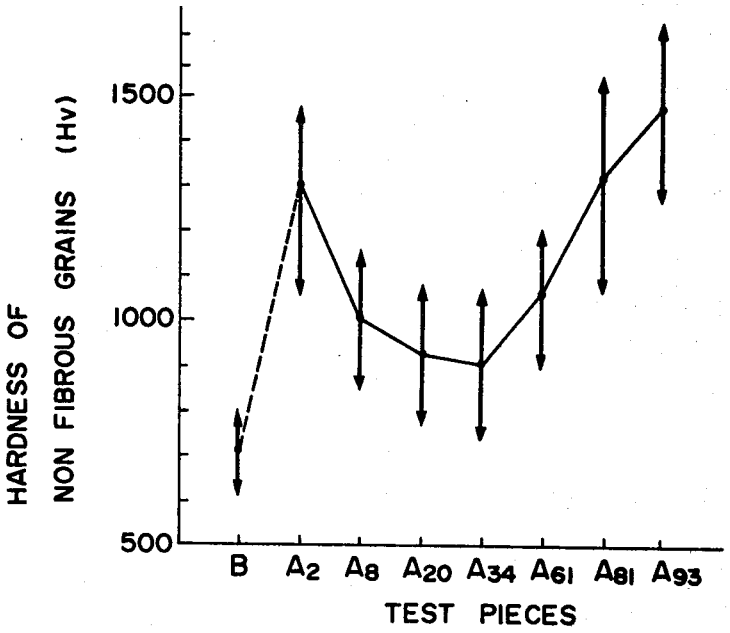
FIG. 11 is a chart, in which hardness of the non fibrous grains in the alumina is shown on the vertical scale in Hv units, for eight test piece samples, seven of which were selected one from each of the test piece sets designated as "$A_2$", "$A_8$", "$A_{20}$", "$A_{34}$", "$A_{61}$", "$A_{81}$", and "$A_{93}$", and one of which was selected from the test piece set designated as "B", the micro Vickers hardness of the non fibrous grains in the alumina, as measured by a micro Vickers hardness gauge using a load of 100 gm.

Next, eight test piece samples, seven of which were selected one from each of the test piece sets designated as "$A_2$", "$A_8$", "$A_{20}$", "$A_{34}$", "$A_{61}$", "$A_{81}$", and "$A_{93}$", and one of which was selected from the test piece set designated as "B", were in turn subjected to a hardness test with a micro Vickers hardness gauge, using a load of 100 gm, to test the hardness of the non fibrous grains which are included as part of the reinforcing fibers and are suggestive of the hardness of the reinforcing fibers. The results of these measurements are shown in FIG. 11.

From this figure, it can be seen that, with regard to the composite materials reinforced with the alumina fibers, as the alpha alumina content by weight of the reinforcing alumina fibers increases from zero up to about 30%, in which the test piece samples designated as "$A_2$", "$A_8$", "$A_{20}$", and possibly "$A_{34}$" which is the transition case, were included, the hardness of the non fibrous grains decreases; but, as the alpha alumina content by weight of the reinforcing alumina fibers increases from about 30% upwards, in which the test piece samples designated as "$A_{61}$", "$A_{81}$", and "$A_{93}$", and possibly "$A_{34}$" which is the transition case, were included, the hardness of the non fibrous grains increases. It is also seen that the hardness of these non fibrous grains is very well correlated with the amount of wear of the cylindrical mating element, in the above described wear test. From the results of this hardness test, it is conjectured that the reason why, when the alpha alumina content by weight of the reinforcing alumina fibers of the composite material was in the range 5% to 60%, that the amount of wear in the above described cutting test on the flank of the superhard bit was small, is that when the alpha alumina content by weight of the reinforcing alumina fibers of the composite material is in the range 5% to 60% the hardness of both the alumina fibers and of the non fibrous grains is relatively low, compared with when the alpha alumina content by weight of the reinforcing alumina fibers of the composite material is outside this range.

THE SECOND PREFERRED EMBODIMENT, USING MAGNESIUM MATRIX METAL

In order to investigate the effect of instead using magnesium as the matrix metal, two sets of test pieces were made of composite material in substantially the same way as before, one using the alumina fibers with 34% alpha alumina content of the sort previously described as the reinforcing material, and the other using the silica/alumina fibers of the sort previously described as the reinforcing material, and using a magnesium alloy (JIS EZ33) as the matrix metal. Further, for comparison, a test piece set was made from this magnesium alloy only, not reinforced by any fibers. Then pieces from each of these three test piece sets were subjected to similar tests as detailed above for the case of aluminum matrix metal; i.e. to a wear test, a cutting test, a rotary bending test, a tensile elasticity test, and a hardness test.

In the wear test, in which the cylindrical mating element was made of spheroidal graphite cast iron (JIS FCD70), both in the case of the test piece manufactured using alumina reinforcing fiber with 34% alpha alumina content, i.e. "$A_{34}$", and in the case of the test piece manufactured using the silica/alumina reinforcing fiber, i.e. the test piece "B", the amount of wear on both the test piece sample and on the cylindrical mating element was very small, as compared with the wear on the test piece manufactured using the unreinforced magnesium alloy only.

However, during the manufacture of the test piece using the silica/alumina reinforcing fiber, i.e. of the test piece designated "B", it was observed that the reinforcing silica/alumina fibers reacted strongly with the magnesium alloy matrix metal. In line with this, during the tests, the strength of this test piece "B" was observed to be rather low. On the other hand, during the manufacture of the test piece using the alumina reinforcing fiber with 34% alpha alumina content, i.e. of the test piece designated "$A_{34}$", it was observed that the reinforcing alumina fibers did not particularly react with the magnesium alloy matrix metal. In line with this, during the tests, the strength of this test piece designated "$A_{34}$" was observed to be acceptably high.

The results of the other tests, i.e. of the cutting test, the rotary bending test, the tensile elasticity test, and the hardness test, were quite satisfactory, in all cases, with regard to the composite materials according to the second preferred embodiment of the present invention.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

TABLE 1

| Particulars / Reinforcing fibers | $A_8$ | $A_{20}$ | $A_{34}$ | $A_{43}$ | $A_{61}$ | $A_{81}$ | $A_{93}$ | B |
|---|---|---|---|---|---|---|---|---|
| Alpha Alumina Content (wt %) | 2.0. | 8.0 | 2.0 | 34 | 43 | 61 | 81 | 93 |
| Alumina Content (wt %) | | | | 94.8 | | | | 47.3 |
| Silica Content (wt %) | | | | 5.1 | | | | 52.6 |
| Mean Fiber Diameter (microns) | | | | 2.9 | | | | 2.8 |
| Non fibrous grains (wt %) | | | | 0.5 | | | | 8.8 |
| Fiber Density (g/cm$^3$) | | | | 0.15 | | | | 0.16 |

What is claimed is:

1. A fiber reinforced metal type composite material: in which the fiber reinforcing material is alumina fiber material formed from at least 80% by weight alumina and the remainder substantially silica, with the alpha alumina content of the alumina approximately between about 5% and about 60% by weight of the total amount of alumina; and in which the matrix metal is selected from the group consisting of aluminum, magnesium, and their alloys.

2. A fiber reinforced metal type composite material according to claim 1, wherein the alpha alumina content of the alumina is approximately between about 10% and about 50% by weight of the total amount of alumina.

* * * * *